United States Patent [19]

Kline

[11] Patent Number: 5,038,542

[45] Date of Patent: Aug. 13, 1991

[54] ARCHITECTURAL BUILDING BLOCK HEREWITH

[75] Inventor: James R. Kline, Petoskey, Mich.

[73] Assignee: Glass Alternatives Corp., Petoskey, Mich.

[21] Appl. No.: 464,948

[22] Filed: Jan. 16, 1990

[51] Int. Cl.[5] ..... E04B 5/46

[52] U.S. Cl. ..... 52/306; 52/307; 40/545

[58] Field of Search ..... 52/306, 307, 308, 590, 52/591, 309.1; 40/312, 541, 545, 552, 553, 564, 570, 574, 584, 606, 661

[56] References Cited

U.S. PATENT DOCUMENTS

| | | | |
|---|---|---|---|
| 3,180,060 | 4/1965 | Persak, Jr. | 52/307 X |
| 4,258,522 | 3/1981 | Amaral | 52/306 X |
| 4,628,652 | 12/1986 | Wefels | 52/306 |
| 4,659,527 | 4/1987 | Kataishi et al. | 52/308 X |
| 4,812,359 | 3/1989 | Hall | 52/308 X |
| 4,870,769 | 10/1989 | Ogilvie | 40/564 |
| 4,891,925 | 1/1990 | Carlson et al. | 52/306 X |

*Primary Examiner*—David A. Scherbel
*Assistant Examiner*—Linda J. Watson
*Attorney, Agent, or Firm*—Mason, Kolehmainen, Rathburn & Wyss

[57] ABSTRACT

An architectural building block is formed of light transmitting, molded plastic material to resemble a common glass block or brick and comprises a plurality of hollow half members joined together along a seam to form a hollow block enclosure with the seam spaced intermediately between a pair of opposite planar outer side faces of the block. Each half member has an inner surface and an outer surface comprising one of the outer side faces of the block integrally joined around its periphery to an inwardly directed peripheral edge flange having a free edge providing one joining edge of the seam. At least one of the outer opposite side faces of the block is provided with a thin, hard, transparent, abrasion, chemical and ultraviolet light resistant protective coating of plastic resin permanently bonded to an outer side face of the block to provide protection from the environment and weather.

20 Claims, 4 Drawing Sheets

"S"

ARCHITECTURAL BUILDING BLOCK HEREWITH

BACKGROUND OF THE INVENTION

1. Field of the Invention

The present invention relates to architectural building blocks and more particularly to a new and improved lightweight, architectural building block formed of light transmitting, molded plastic material having a thin, hard, transparent, abrasion resistant surface coating of plastic resin permanently bonded on at least one side face of the block.

The lightweight, molded plastic building block of the present invention provides a number of important features and advantages over conventional glass building blocks and these features include: (1) weight reduction of 50% to 75%; (2) high impact resistance against external and internal forces; (3) the plastic block is nearly indestructible in normal or abusive situations; (4) some 250 times stronger than an ordinary glass block; (5) 20% to 30% improved thermal efficiency over that of a glass block; (6) an optical quality equal to or better than that of a glass block; (7) provides increased security and safety; (8) unlimited color and tint selections are available; (9) detachable snap lock connector assemblies eliminate the need for skilled labor in assembling or building structures made up of the blocks; (10) RTV silicone and other adhesives can be utilized in place of conventional mortar joints, thereby eliminating the need for special tools and masonry skills; (11) decorative features including relatively low cost interior surfaces of gold, silver and other metals can be provided easily by vacuum deposition, sputtering, etc.; (12) unlimited graphics and indicia are readily obtainable in molded form on outer surfaces including company logos, initials, special designs and shapes which can be economically produced; and (13) the interior of the block is readily illuminated for decorative and/or security needs.

A new and improved architectural building block in accordance with the present invention is produced in a low stress, injection molding process of the type more fully described and set forth in copending U.S. patent application Ser. No. 07/389,338, filed Aug. 3, 1989 for a PANEL AND METHOD OF MAKING THE SAME, which patent application is hereby incorporated herein by reference.

2. Background of the Prior Art

Over the years, a wide variety of architectural building blocks commonly known as glass blocks or glass bricks have been developed for use in exterior walls, interior walls and/or other types building structures. Austrian Patent Nos. 169151 and 183209, Belgian Patent No. 567594, Canadian Patent No. 712300, French Patent Nos. 1155005, 1186063, 1196461 and 1341653 and U.S. Pat. Nos. 951,010, 2,170,602, 2,194,756, 3,387,421, 3,422,588, 3,438,165, 3,798,861, 3,954,326, 4,004,392, 4,628,652 and 4,852,321 generally disclose glass blocks or glass bricks used for buildings and the like, having one or more drawbacks in that they are relatively heavy, easy to break, low in strength, easily damaged and have generally poor heat insulating or heat transfer characteristics.

OBJECTS OF THE PRESENT INVENTION

It is an object of the present invention to provide a new and improved architectural building block, and more particularly, a new and improved architectural building block formed of light transmitting, molded plastic material.

More specifically, it is an object of the present invention to provide a new and improved architectural building block of the character described having a number of important advantageous features as previously set forth herein which provide distinct advantages over common glass blocks or glass bricks now available.

Another object of the present invention is to provide a new and improved architectural building block formed of light transmitting, molded plastic material which is relatively low in cost, relatively light in weight and has an outer surface that is highly resistant to impact and abrasive forces.

Another object of the present invention is to provide a new and improved architectural building block which is nearly indestructible in normal and even abusive situations and which is as much as 250 times stronger than a glass block counterpart.

Another object of the invention is to provide a new and improved architectural building block of the character described which has a greatly improved thermal efficiency and an optical quality equal to glass, thus providing increased security and safety.

Another object of the invention is to provide a new and improved architectural building block of the character described which will permit unlimited color or tint selection and which includes a snap lock assembly for eliminating the need for skilled labor in making up a wall or other structure employing a number of the blocks.

Still another object of the present invention is to provide a new and improved light transmitting building block of molded plastic material which utilizes silicones or other adhesives in place of mortar joints and thus eliminates special tools and masonry skills previously required for glass blocks.

Another object of the invention is to provide a new and improved architectural building block utilizing low cost means for providing mirrored inside surfaces of gold, silver, effect and/or other decorative metals.

Another object of the present invention is to provide a new and improved decorative architectural building block which lends itself readily to the application of indicia and a wide variety of graphics integrally molded on a face thereof.

Still another object of the present invention is to provide a new and improved decorative architectural building block which may be easily illuminated from the interior for setting decorative designs and security needs.

BRIEF SUMMARY OF THE PRESENT INVENTION

The foregoing and other objects and advantages of the present invention are accomplished in a new and improved decorative architectural building block formed of light transmitting, molded plastic material generally resembling a glass block or glass brick. The new and improved plastic building block comprises a plurality of hollow half members joined together along a seam to form a hollow block enclosure with the seam joint spaced intermediately between a pair of opposite outer side faces of the block.

Each half member includes a continuous molded inner surface and has an outer surface comprising one of the outer side faces of the block which is integrally joined around its periphery to an inwardly directed peripheral edge flange having a free edge providing one joining edge of the seam joint. At least one of the opposite outer side faces of the block is provided with a permanent thin, hard, transparent, abrasion, chemical and ultraviolet light resistant protective coating layer of plastic resin which may be tinted as desired to provide a wide variety of color effects. The inner and/or outer surfaces of the block may be provided with integrally molded indicia such as company logos, advertising slogans, names, art designs and shapes, etc., as desired. The inner and/or outer surfaces of the block may be mirrored and/or provided with a wide variety of indicia applied by vacuum deposition, painting, sputtering, etc. before or after the half members are assembled, and the blocks may be provided with decorative internal illumination as desired.

BRIEF DESCRIPTION OF THE DRAWINGS

For a better understanding of the present invention, reference should be had to the following detailed description taken in conjunction with the drawings, in which.

DETAILED DESCRIPTION OF PREFERRED EMBODIMENTS OF THE PRESENT INVENTION

Figures 1, 2:
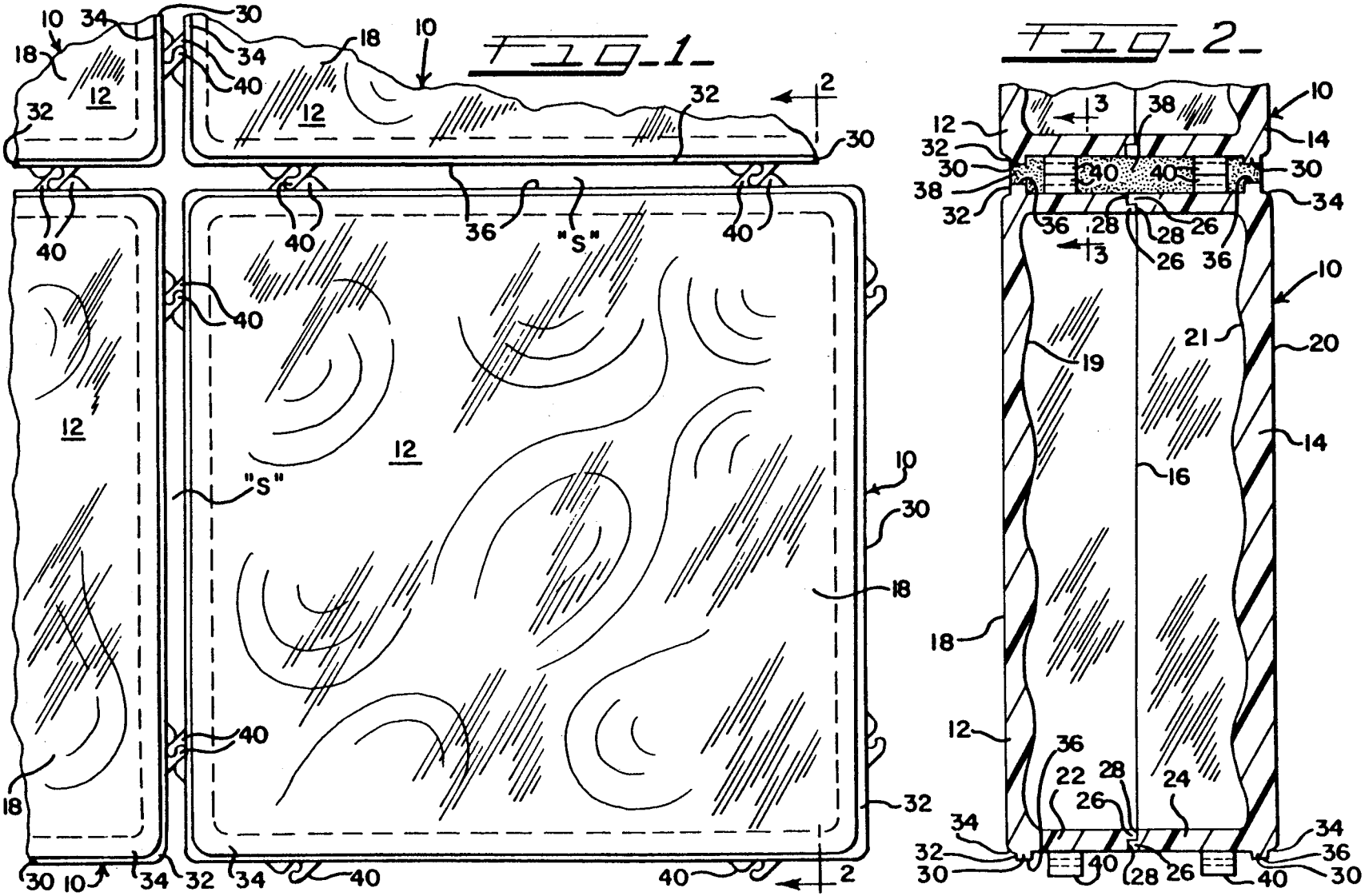
FIG. 1 is a side elevation view illustrating a new and improved architectural building block constructed in accordance with the features of the present invention.
FIG. 2 is a transverse cross-sectional view taken substantially along lines 2—2 of FIG. 1.
Figure 3:
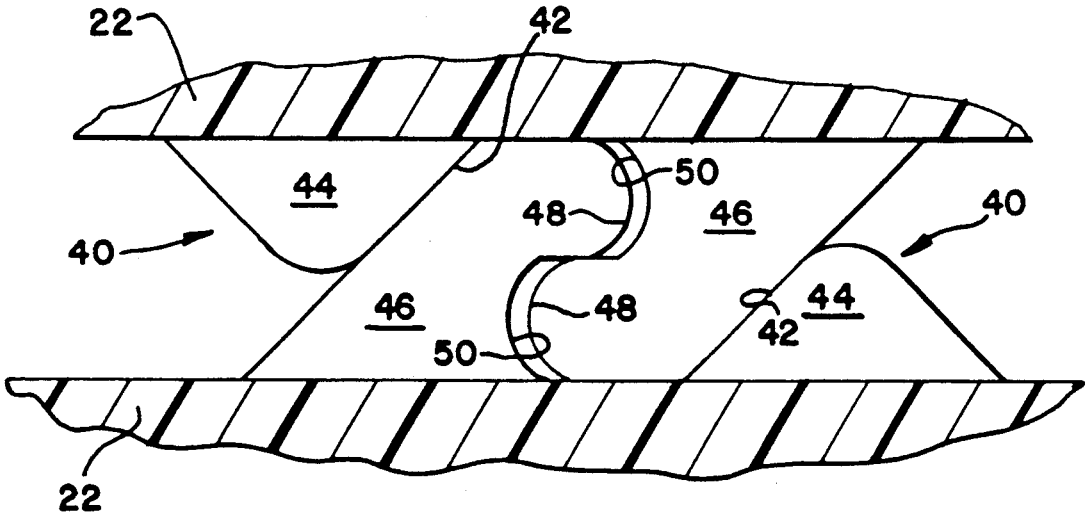
FIG. 3 is a transverse cross-sectional view, greatly enlarged in scale taken substantially along lines 3—3 of FIG. 2.

Referring now more particularly to the drawings, therein is illustrated in FIGS. 1, 2 and 3, one embodiment of a new and improved architectural building block formed of light transmitting, molded plastic material constructed in accordance with the features of the present invention and indicated generally by the reference numeral 10. The building block 10 is formed of light transmitting, molded plastic material in an injected molding process and includes a pair of halves or half members 12 and 14 which are substantially identical except for structure forming a seam joint 16 spaced intermediately between and parallel of a pair of opposite outer side faces 18 and 20 of generally rectangular shape such as a square, rounded at the corners as shown. Each half member 12 and 14 includes an integrally molded peripheral edge flange 22 and 24, respectively, joined around the periphery of the side face 18 or 20 of the block 10 and extending inwardly thereof to seam joint 16 as best shown in FIG. 2.

Figure 7:
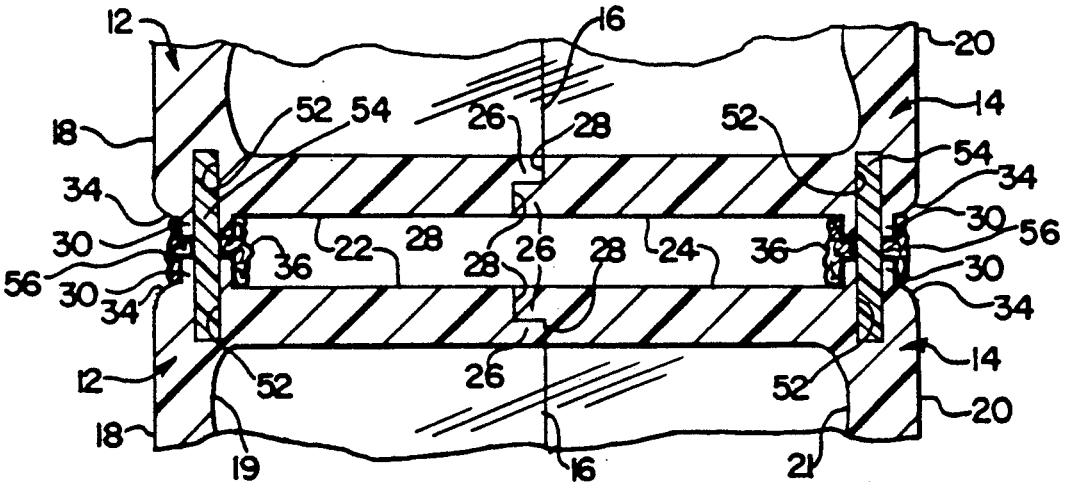
FIG. 7 is a fragmentary enlarged cross-sectional view similar to FIG. 3, but illustrating an alternate system for assembling and aligning the spacing or interval between a pair of blocks assembled in a wall structure or other assembly.

Along an inner free edge, each continuous peripheral edge flange 22 or 24 includes a tongue element 26 adapted to seat in a groove 28 formed on an opposite half member so that when the two members are assembled together as shown in FIGS. 2 and 7, a complete hollow enclosure is formed and the interior of the block 10 may be sealed off against the entry of outside environmental elements when desired.

The tongue and groove joint is formed along the seam line 16 midway between the opposite outer side faces 18 and 20 of the block 10 and can be made water and vapor tight by a chemical bond, a sonic weld, an epoxy bond or silicon vapor seal. As will be described hereinafter, unsealed units may be utilized with decorative internal lighting or other types of displays. The bond provided along the seam joint 16 provides physical strength resulting in an exceedingly strong hollow block enclosure.

As illustrated in FIG. 1, the decorative architectural building block 10 has rounded corners and the side faces 18 and 20 have a polygonal shape as illustrated, with a preferred shape being square as shown. Around the periphery of the inwardly extending peripheral side flanges 22 and 24 of the respective hollow half members 12 and 14, there is provided an outwardly projecting peripheral rib or ridge 30 that is spaced inwardly of the outer surface of a respective side face 18 or 20 and formed of a generally rectangular transverse cross-section as best shown in FIGS. 2, 7, 8 and 9.

Each rib 30 has an outwardly facing side edge 32 which joins into a rounded transition or corner 34 blending into the adjacent planar side face 18 or 20 of a respective half member 12 or 14. Each rib also includes a wide face 36 parallel of an outer face of the respective peripheral edge flanges 22 and 24. When a plurality of blocks 10 are assembled together as shown in FIGS. 1, 2 and 7, the rib faces 36 are maintained in a selected parallel spaced apart relation as shown in FIG. 1 and designated by the letter "S". When the blocks are assembled together the spacing "S" between the ribs 30 provides a nice, smooth, even dimensioned joint for mortar 38 or a silicone sealant 56 used when assembling the blocks together to form a building wall or other structure.

The outer edge faces 32 of the peripheral ribs 30 provides a smooth, even surface so that mortar joints 38 may be smoothly finished to be even with the outer surfaces 32 of the ribs 30 as shown in FIG. 2, but spaced slightly inwardly of the outer surfaces 18 and 20 of the half members 12 and 14 of the blocks 10. This results in an extra neat appearance for a wall or other structure built up with the blocks 10 as illustrated in FIGS. 1 and 2.

In accordance with the present invention, for the purpose of aiding the assembling of the blocks into a structure and for positively securing the blocks in a correct position while maintaining an accurate even spacing "S" between the ribs 30 of adjacent blocks, each block 10 is provided with a plurality of snap lock connectors 40 integrally formed on the respective half members 12 and 14 intermediately between the rib 30 and the joining edge of the block along the joint seam 16.

As shown in enlarged detail in FIG. 3, each snap lock connector 40 includes a groove 42 formed between a triangularly shaped projection 44 and a finger or tongue 46 having an enlarged outer end portion 48 adapted to snap into and be received in an enlarged inner end portion of a groove 50 formed on an adjacent block when a pair of blocks are snapped together. The tongues 46 on one block are adapted to snap fit into the grooves 42 of an adjacent block to positively interlock the blocks together with a precise amount of space "S" obtaining between the faces 36 of adjacent ribs 30 of adjacent blocks.

Each block 10 is generally polygonal in shape and the continuous peripheral edge flanges 22 and 24 of the respective half members 12 and 14 are formed to include a plurality of generally planar flange segments integrally interconnected in an end to end relation. One or more snap lock connectors 40 may be provided on each planar flange segment and appropriately located thereon with respect to the corners of the blocks so as to neatly interfit with the snap lock connector 40 on an adjacent block laid up in place above or in end to end relation therewith. The snap lock connectors 40 serve as spacers in addition to their function as structurally interconnecting elements to positively secure the blocks 10 together.

Once blocks 10 are secured together with the snap lock connectors 40, the mortar 38 or other sealant-/adhesive is introduced into the space "S" between the blocks to fill the space between blocks and surround the snap lock connectors 40 so that the connectors are not visible from outside a finished wall of blocks after a mortar or silicon fill is in place. Because the snap lock connectors 40 are integrally formed on the flanges 22 and 24 of the blocks 10, it is possible for an unskilled workman to assemble the blocks as desired and thereafter insert mortar 38 or other types of fillers 56 between the blocks into the space "S" with a mortar or caulking gun and with little manual dexterity or skill being needed.

Referring now more particularly to FIG. 7, a modified type of spacing system may be provided for ease in laying up the blocks 10 in an accurate, selfaligning process. Each block 10 may be provided with a plurality of blind bores 52 of a precise depth precisely located adjacent corner portions of the ribs 30 in order to receive spacing pins 54 of a prescribed length which are inserted into the bores to maintain a selected interval of spacing "S" between the surfaces 36 of adjacent ribs 30 of adjacent blocks. Increasing the length of the spacing pins 52 obviously increases the thickness of the mortar joint.

In addition to common mortar, a silicone filler known as RTV filler in white or grey or other colors, may be utilized to provide an easy interconnection between edge portions of adjacent blocks 10 and to provide a weather-tight seal similar to a mortar joint. A silicone filler strip 56 may be laid in place with a common caulking gun.

As an alternative means for centering and securing the blocks 10 together, a double backed tape of 1/16" to 3/32" thickness may be mounted along the rib faces 36 of the rib 30 to temporarily secure the blocks together. These tapes may be discontinuous and are formed in short segments to permit the extrusion of silicone filler between adjacent edge portions of the blocks 10 as shown in FIG. 7.

Figure 8:
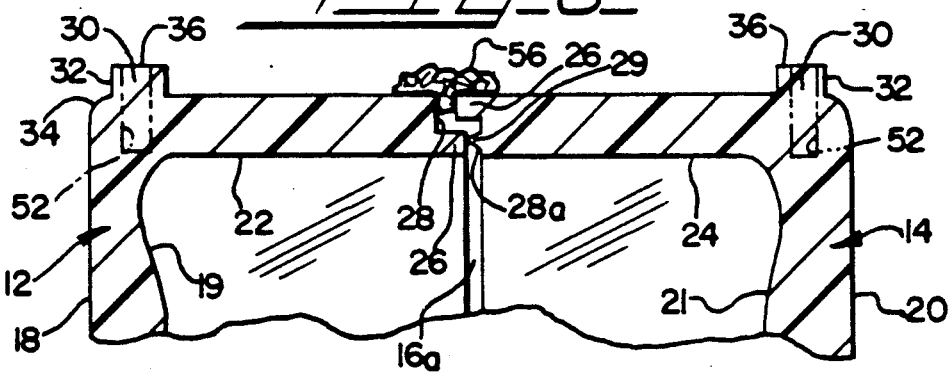
FIG. 8 is an enlarged transverse cross-sectional view illustrating one form of a seam provided around the block intermediately between opposite side faces thereof.

Referring now to FIG. 8, therein is illustrated a modified form of seam joint 16A for a block 10 wherein one of the grooves of the joint, labeled 28A is provided with a triangular cross-sectioned elongated rib 29 for the purpose of making a continuous peripheral sonic weld between the half members 12 and 14. An elongated bond and sealing strip 56 of silicone sealant may also be provided after the weld has been completed and the members 12 and 14 are pressed tightly together. As ultra-high frequency sonic energy is applied in the region of the triangular-shaped rib 29, fusion between the rib and the adjacent tongue 26 on the opposite half member 12 occurs and the members 12 and 14 are then pressed tightly together to form a sealed hollow enclosure for the completed block 10.

Figure 9:
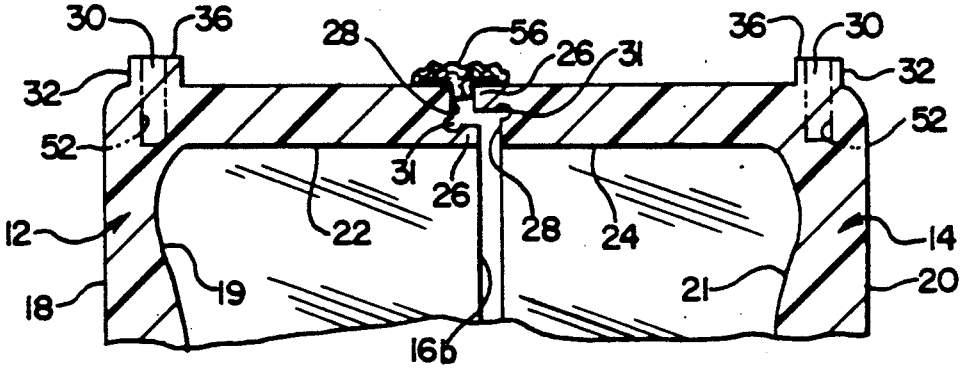
FIG. 9 is an enlarged fragmentary transverse cross-sectional view showing yet another form of seams between opposite halve members in a block in accordance with the present invention.

Referring now to FIG. 9, a modified form of joint seam 16B may be provided for joining the half members 12 and 14 wherein a circular cross-sectioned groove 31 is provided along the junction of a tongue face and a groove face of each half member in order to provide a liquid track to receive a flow or liquid chemical bonding mixture applied to the respective members for cementing and positively bonding the two half members 12 and 14 together to form a water and vapor tight sealing joint 16B. In addition, a strip of silicone adhesive sealant or filler 56 may be provided on the outside surfaces of the respective side edge flanges 22 and 24 as indicated.

Figure 4:
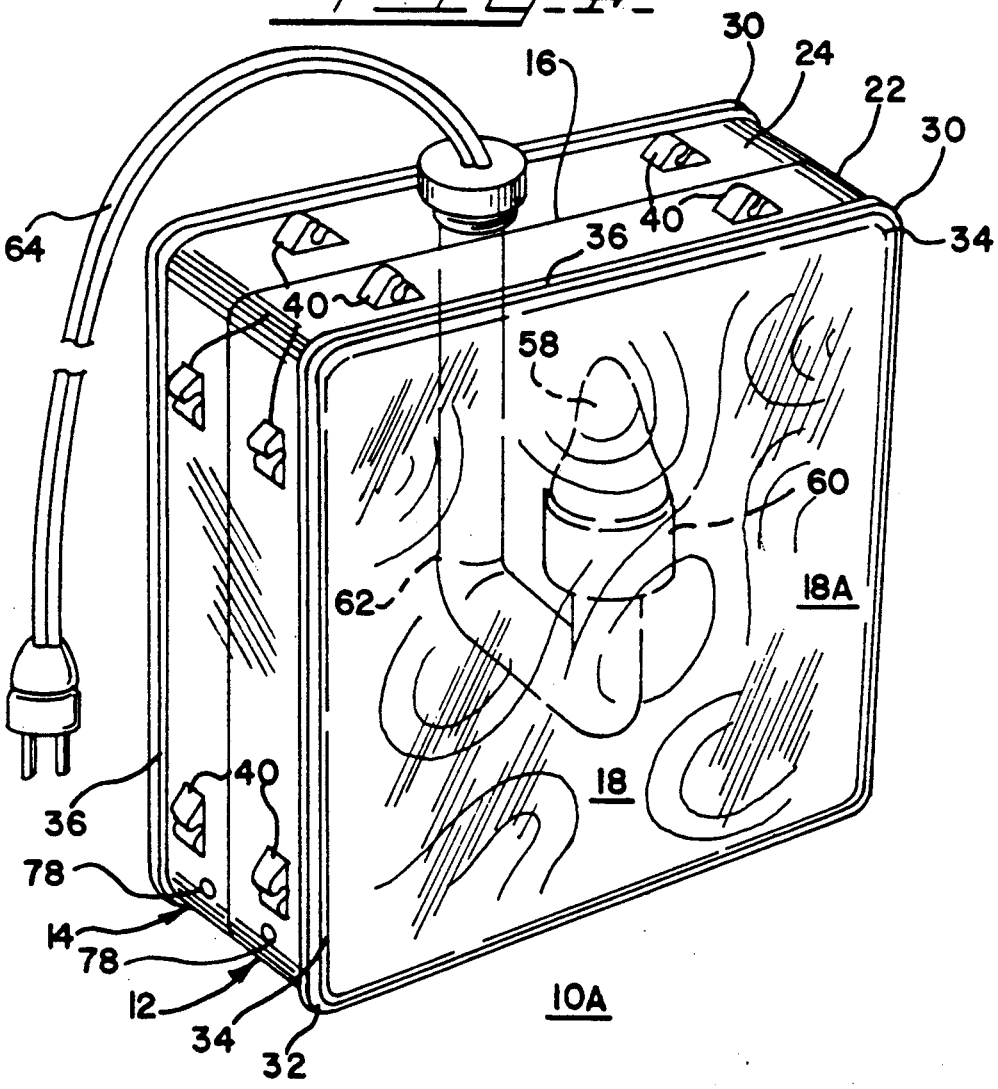
FIG. 4 is an elevational perspective view of one form of a decorative architectural building block in accordance with the present invention having an internal illuminating system.

Referring now to FIG. 4, another embodiment of a decorative architectural building block 10A is therein illustrated wherein a light bulb 58 is mounted in the hollow interior of the block to illuminate one or both side faces 18 and 20 thereof when the light is energized. The light is supported in a socket 60 which, in turn, is supported from a J-shaped tubular element 62 having an upper end secured in place and projecting outwardly through an aperture provided in an upper planar wall segment of the side edge flange 24. A line cord 64 is provided to supply energy to illuminate the light 58 and the line cord can extend along a row of blocks the space "S" between adjacent blocks when the blocks are laid up in a wall or other structure as previously described.

Referring momentarily to FIGS. 2, 7, 8 and 9, the interior surfaces of the hollow half members 12 and 14 may be provided with molded irregular faces 19 and 21 respectively of any desired shape so as to provide a wide variety of light patterns and decorative effects in a block 10A when illuminated from the interior thereof by a light 58, or the like.

Figure 5:
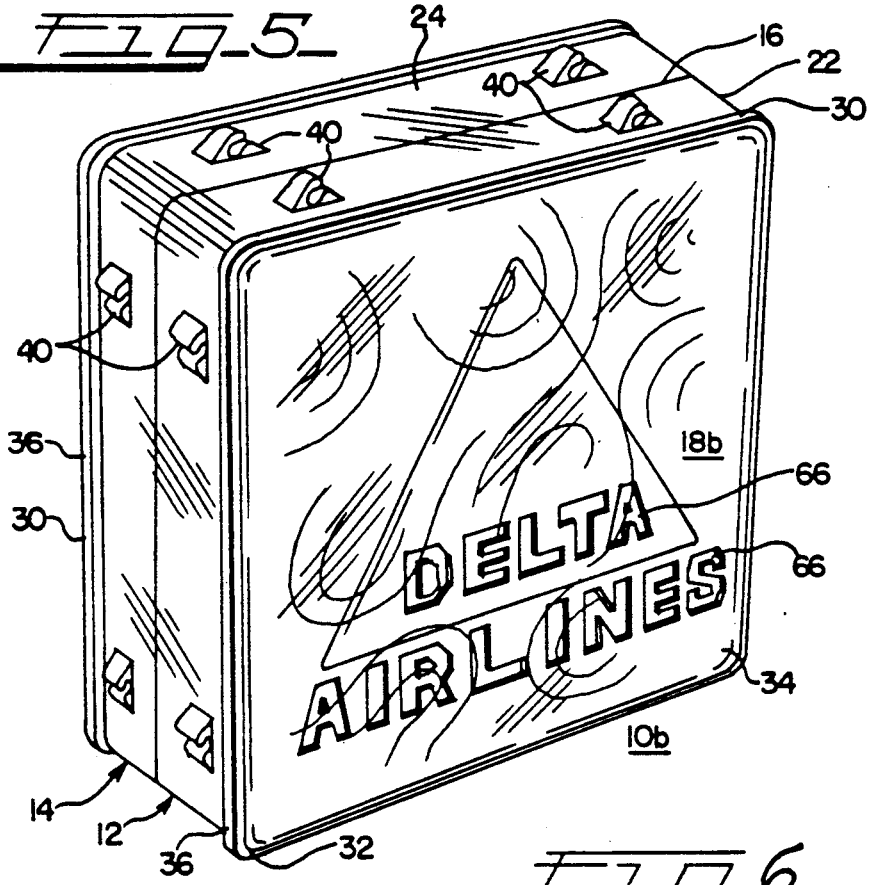
FIG. 5 is an elevational perspective view of another form of a decorative architectural building block in accordance with the present invention having a decorative company logo formed on a side face of the block.

Referring now to FIG. 5, therein is illustrated another embodiment of a decorative architectural building block 10B wherein indicia such as a company logo or name may be permanently molded into the inner surface or the outer surface 18B of a block half member 12. As previously described in the previously mentioned copending U.S. patent application, which is incorporated herein by reference, the inside surface of the half members may be made planar or flat, if desired, and/or a company logo or other indicia or decal may be applied thereto and formed of reflective metal such as gold, silver, a mirror finish or other metals and these metals may be vacuum deposited on the inner or outer surface of the blocks 10B as desired. Moreover, as previously described, the molded plastic material of the half members 12 and 14 may be tinted in a wide variety of colors and shades, as desired, to provide for both esthetics and for reduced heat transmission through the blocks as well as decorative coloring.

Figure 6:
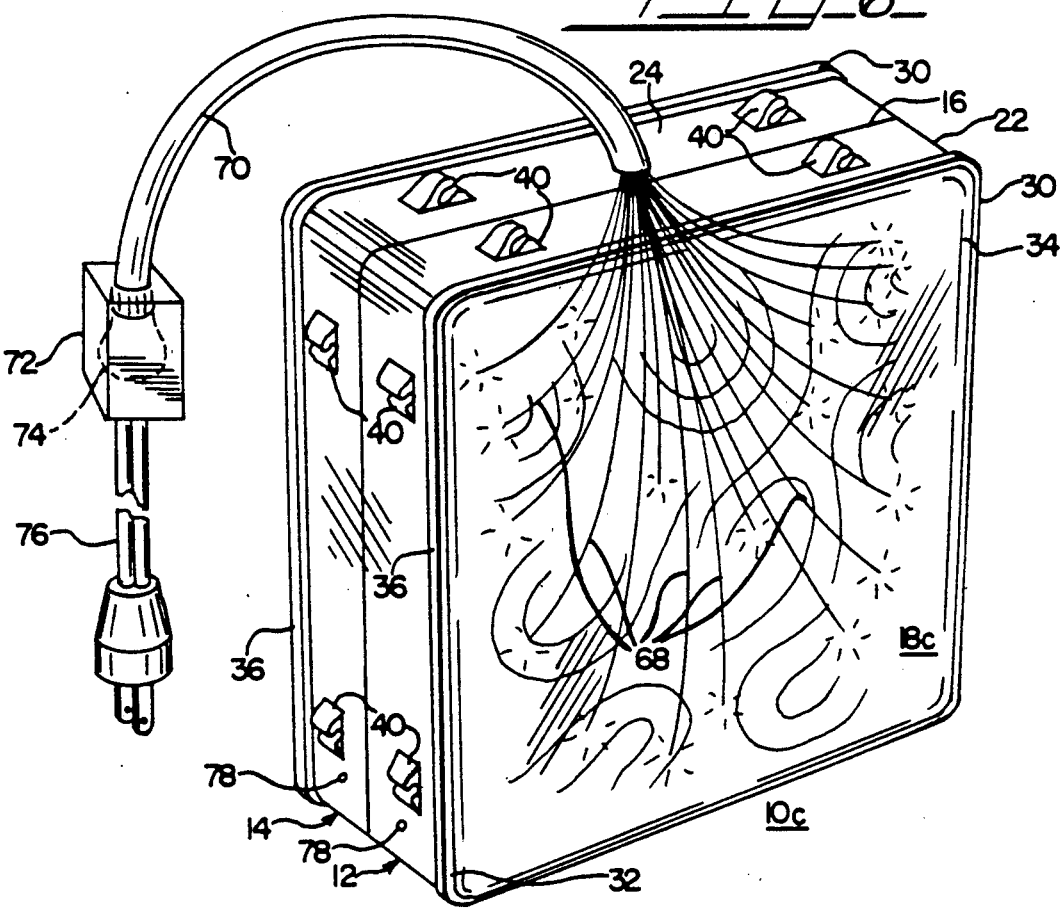
FIG. 6 is an elevational perspective view of yet another form of a decorative architectural building block in accordance with the present invention having another type of decorative internal illumination system.

Referring now to FIG. 6, therein is illustrated another embodiment of a decorative architectural construction block 10C in which a modified form of internal illumination is provided, including a plurality of light transmitting, strand-like, elongated elements 68 which are introduced into the interior of the block 10C via an opening in an upper planar segment of an inwardly extending peripheral edge flange 24. These light transmitting, elongated strand elements 68 may be arranged in a variety of different patterns to provide a wide variety of novel lighting effects. The strands are contained exteriorly of the block 10C in a plastic sheath or guide tube 70 which is connected to a light chamber 72 wherein a light bulb 74 may be illuminated to direct light energy into the light receiving inner ends of the strand elements. The light bulb 74 is energized through a conventional line cord 76.

One or more vent holes 78 may be provided at lower levels in the peripheral edge flanges 22 and 24 of the half members 12 and 14 of the blocks 10A, 10B and 10C, etc. in order to permit air circulation through the interior of the hollow enclosures to carry away excess heat that may be generated by the light and/or illumination process. The vent holes 78 may also serve to vent or drain out any accumulating moisture from the interior of blocks from time to time.

In accordance with the present invention, the unique architectural building blocks 10 are formed in a low stress injection molding process wherein internal stresses remaining in the blocks after manufacture are maintained below 1500 psi or less and wherein at least one of the molded outer side faces 18 or 20 has an optical quality, surface finish. Plastic resins such as a polycarbonate resin or acrylic resin is injected into a precision, highly polished, metal mold while in a liquid state at a relatively high temperature and is cured to a solid state while still remaining within a mold cavity.

The resin used is injected into the mold at an initially high injection pressure of up to 60,000 psi and a vacuum is applied to the mold cavity in order to rapidly draw the resin into the mold cavity while the cavity surfaces are maintained at a relatively high temperature so as to preclude premature skin formation or crusting of the resinous material as it first enters and fills the mold cavity. This arrangement insures that a completely filled mold cavity is rapidly achieved in an injection operation. The molded resin of the half members 12 and 14 is cured in a relatively short period of time while the members are still retained in the mold cavity and thereafter, when the mold is opened and the half members removed therefrom, additional annealing processes are not required for further reducing internal stresses. By elimination of most or all of the mold or process induced internal stresses in the half members 12 and 14 of a block 10, the outer surface thereof is more readily bondable with a thin, tough, hard, clear coating of abrasion resistant, polycyloxine resin, and/or an ultra-violet (UV) curable resin layer or protective coating applied by flow coating, dipping or spraying.

An abrasion resistant, glossy appearing, clear, protective coating surface layer is applied in a processing environment having a high degree of cleanliness and precise humidity control, preferably in a relative humidity range of between 35% to 50%. A suitable curing time is provided to insure an exceptionally clear and hard outer surface coating that is permanently bonded onto the optical quality surfaces 18 or 20 of the block 10, which block is formed with a low stress, injection molded, resin. The resulting block is extremely pleasing in appearance and very closely resembles and/or simulates glass blocks or glass bricks while at the same time providing many distinctive advantages over glass.

In accordance with the present invention, the half members 12 and 14 are preferably constructed of injection molded polycarbonate or acrylic, plastic resin and these resins are chosen because of their clarity and high light transmission capability. Moreover, these resins have a relatively low thermal conductivity, high impact strength, are relatively low cost, and have an excellent ability to withstand ultraviolet light and weather exposure for long periods of time without substantially discoloring, crazing or cracking, even when subjected to a relatively high degree of physical abuse.

The resins are molded in a low stress, high temperature injection molding process as described hereinafter wherein the finished molded half members 12 and 14 have very low permanent internal stresses, typically ranging between 400 psi and 1500 psi after manufacture and final curing is completed. Preferably the internal stresses developed in the resinous material while flowing into the mold and during the molding process is maintained at a level of 1500 psi maximum or below.

In order to produce these low stress molded members 12 and 14, the resin is injected into the mold cavity at or near a high temperature limit as recommended by the resin manufacturer. For example, when polycarbonate resin is utilized, a temperature of 600° to 610° F. is used to increase fluidity and assist in the flow of the resin material across the mold cores and into the cavities of the mold. Initial injection pressure at the inlet of the mold may be as high as 60,000 psi with a range of 30,000 psi to 60,000 psi preferred so as to rapidly deliver the needed quantity of resin to fill the mold cavity in an extremely short period of time, for example, about one or two seconds.

In addition, while the injection molding process takes place, the mold cavity ahead of the flowing resin is being evacuated by means of a vacuum pump so that the liquid resin is both pushed and pulled rapidly into the mold cavity. A vacuum range in the order of 27 to 28 inches of mercury below atmospheric is preferably maintained from a suction line connected between the mold cavity and a vacuum pump.

The resin is cured while retained within the mold cavity during a 25 to 45 second time interval after mold filling is completed. The curing time required is dependent upon the wall thickness of the half members 12 and 14 being molded. When relatively thick ribs or wall sections are needed, additional curing time in the mold cavity is provided; for example, 60 to 90 seconds may be required. Additional curing time of up to 4 hours at a temperature range of 220°-240° F. and a dew point temperature of −20° F. may also be provided when necessary.

The combination of high initial resin temperature, (575°-610° F.), high mold surface temperatures (200° F.-230° F.) in the entry portion of the mold cavity and high initial injection pressure is extremely important in producing a final low internal stress condition in the finished molded blocks 10.

In the past, conventional injection molding processes often resulted in relatively high internal stresses being developed in molded plastic articles; sometimes in excess of 2,500 psi. With stresses at this high level, the quality of adhesion between these molded plastic articles and hard surface coatings applied thereto was low, resulting in the formation of micro-cracks in the coating layer and delamination between the resin substrate and the outer coating layer when subjected to normal thermal cycling between −40° F. and +170° F.

These tendencies to form micro-cracks in the outer coating layer and delamination of the outer coating layer from the molded underlying plastic resin substrate is believed to be a result of the relatively high internal stress levels produced in the base substrate in a conventional molding operation. When thermal cycling occurs, the high level of internal stress results in a substantial movement of the base resinous substrate which tends to foster micro-cracking and delamination. In order to reduce this tendency, it was often necessary to post anneal prior articles in another secondary operation which is costly and time consuming. Moreover, typical annealing processes have a wide range of variables and inconsistency results unless highly accurate control is provided, which again is costly and time consuming.

The relatively low levels of process-induced, internal stress provided in the molded plastic substrates produced in accordance with the teachings of the present invention, result in a greatly improved permanent adhesion between the substrate surface and the hard protective outer coating layer, and expensive and time consuming post annealing operations are eliminated altogether. In the past, it was common to provide a post annealing process in order to reduce internal stress down to levels of approximately 750 psi in the substrate and the elimination of this costly and difficult to control secondary operation is a great economic incentive provided by the present invention.

In accordance with the invention, after the half members 12 and 14 are molded in the manner described to insure a low level of process induced internal stress of 1500 psi or less, and after a final curing of the members is completed forming an optical quality surface finish on the outer side faces 18 and 20, a thin, clear, light transmitting, abrasion resistant, ultra-violet light resistant, relatively hard, protective coating or layer of plastic resin is applied to the outer surface of the substrate. This thin outer protective layer may reach a maximum thickness of up to 1 mil and adheres to the surface of the substrate to form a permanent bond against later delamination. The protective layer is cured by the passage of the half member 12 and 14 under a heat lamp and in a typical operation, the members may move at a velocity of 15 to 30 feet per minute past the heat lamp so that surface temperatures of 220° F. to 240° F. are present on the thin, hard, outer protective layer or coating.

The hard surface protective layer or coating provides excellent abrasion resistance and excellent resistance to deterioration of the blocks 10 and the substrate thereof when prolonged exposure to the weather and/or ultraviolet light is experienced. Moreover, molded plastic blocks 10 produced in the aforementioned method, are well able to resist delamination between the substrate and outer protective coating layer.

Typically a suitable outer protective layer comprises a polycyloxine resin which is applied to the cured substrate in a flow coating, dip coating or spray coating operation so that the resulting outer side faces 18 and 20 assume a high gloss, hard finish which closely resembles a common glass block. Moreover, to the untrained eye, it is often difficult to ascertain that the blocks in accordance with the present invention are not actually glass blocks of a prior era.

In accordance with the present invention, one or both of the half members 12 and 14 of a block 10 can be easily tinted to the shade or color desired by the introduction of tinting material into the molding resin of the substrate prior to or during the molding process. The tinted members offer improved thermal efficiencies and reduce the transmission of light. The tinting shades may be of a type that especially reduces harmful infared and UV range radiation through the block faces 18 and 20. Polycarbonate and acrylic substrates, can be easily and economically tinted to make architecturally pleasing shades and colors such as bronze, grey, white etc. and these shades and colors may provide a permanent decorative alternative to clear glass.

In addition to cosmetics, there are two other areas of advantages afforded in tinted blocks 10. The tinting feature provides excellent security to a person inside a wall of blocks 10 by offering viewing to the outside, while at the same time providing obscurity when an intruder looks inside, because of the light transmission reduction of the tinted side faces (20%–60%). A person can easily observe a would-be intruder's activity through a tinted block wall.

Block 10 of polycarbonate resin provide superior vandal and intruder resistance so that damage is minimized or eliminated because the blocks are virtually unbreakable under normal impact. Security from damage by small caliber firearms is also provided in block wall constructions using blocks 10 having a 3/16" outer side face thickness and/or a ⅛" side face thickness on an inside wall surface.

Architectural and security tints offer reduced light transmission of harmful sunlight containing infared and UV ranges of light with the effect of retaining heated or cooled air on the desired side of a structure or wall. This feature provides economy through heating and cooling cost reductions and in certain circumstances protects against sun damage to interior furnishings and fixtures.

The safety and security features of the new blocks 10 provide new architectural freedom in areas previously declared as unsafe or hazardous and offer a great improvement in installations wherein glass breakage is a hazard such as in shared dwellings, townhouses, condominiums, public buildings and common use entryways.

Control of resin melt and flow can maintain stress levels below 1000 psi in a molded transparent substrate of the blocks 10 in accordance with the invention. Low stress levels optimize the physical properties of the substrate and offer improved adhesion of secondary coatings such as paint and abrasion resistant coatings. These low stress levels significantly reduce expansion and contraction of a molded substrate due to extremes in thermal cycling.

There are three basic manufacturing elements used to accomplish low stress injection molding: (1) high quality steel injection molds, (2) microprocessor-controlled, closed loop molding machines, and (3) molding resin/-base substrates of acrylic or polycarbonate that are certified by the manufacturer of the resins to meet a narrow range of manufacturing specifications.

High quality pre-tempered 32–34 RC steel is used to provide optical quality surface finishes, for optimizing at 84%-94% thr amount of light transmission for acrylic and polycarbonate molding resin of the block half members 12 and 14.

Thermal control of mold core and cavity plates is provided to evenly control and distribute mold surface temperature, and cooling lines are installed radially or in a cross hatch pattern over the mold surfaces. Monitoring of mold surface temperatures is conducted by thermocouples that are installed beneath the mold core and the cavity surfaces and which are interfaced with a molding machine process controller. Control of cooling water flow and temperature is provided with temperature controllers having two (2) to four (4) units per mold half. Each controller is interfaced with an injection molding machine microprocess controller.

Venting of the mold plates is utilized to evacuate cavity air pressure from the resin injection fill and is accomplished by a vacuum venting process utilizing a vacuum venturi and interfacing same with an injection machine microprocess controller. The fill speed of the resin is timed to the evacuating speed of cavity pressure build from the fill in order to eliminate/minimize flow front pressures. Microprocessor monitored pressure transducers are placed on each mold half to monitor pressure at critical flow length points to assure a balance of mold fill and low pressure requirements.

The blocks 10 are manufactured in molding machines which include a microcomputer that interfaces with a hydraulic system, an injection mechanism, a mold clamping unit and an injection type, high quality mold. The microcomputer monitors and controls each of the key functions of the molding process and utilizes information received from the injection mold via thermocouples, pressure transducers and the vacuum venturi. Various international manufacturers of suitable molding machines include Engel Machinery located in Guelph, Ontario, Canada.

Control of the resin used in making the blocks 10 is essential to maintain desirable physical properties and optical appearance. Only minimum amounts of release agent are required insure minimum adhesion and distortion of the glass-like surfaces of the molded block 10. A suitable polycarbonate resin is manufactured by the Mobay Chemical Company located in Pittsburgh, Pa., and by the General Electric Company located in Pittsfield, Mass. A suitable acrylic resin is manufactured by Rohm & Haas in Philadelphia, Pa., Continental Polymers in Los Angeles, Calif., and Cyro Plastics in Mount Arlington, N.J.

Abrasion resistant clear protective coats for the half members 12 and 14 are applied as a secondary operation by means of flow coating, dip coating or spray coating. Special custom coating equipment is utilized and in addition, the process environment requires cleanliness and humidity control (Class 100 and 35%-50% relative humidity). Close control of cure time and film build on coating thickness is extremely important to maintain a proper adhesion and abrasion resistance on the plastic resins of the basic half members 12 and 14.

The abrasion resistant coatings used on the blocks 10 include polysiloxanes and UV curables. These materials provide a glass-like hardness to an otherwise soft acrylic or polycarbonate surfaces of a half member 12 or 14. In addition to abrasion resistance, major protection is provided for resistance to chemicals and protection from ultraviolet sunlight or UV emitting lamps/-lights.

No standard type of equipment generally exists today made especially for the application of protective coatings for the blocks 10, however, suitable coating application units are manufactured by Thierica Inc., Grand Rapids, Mich. and the Rockwell Corporation, Fairfield, Conn.

The blocks 10, 10A, 10B and 10C are useful as an art decorative or functional lighting unit in conjunction with or independent of other wall components. A decorative message or logo can be provided on an inside surface of the block side faces 18 and 20 via silk screening, pad printing, hot stamping, air brushing vacuum metalizing, sputtering, or spray painting. Engraved exterior graphics, logos and patterns, including etched graphics or messages can be provided on both the inside surfaces and the outside surfaces of the decorative blocks 10, 10A, 10B, 10C, etc.

The basic construction and assembly of the blocks 10, 10A, 10B and 10C can be offered to the user in at least two distinct versions. The half members 12 and 14 may or may not have mirror images on the decorative side faces 18 and 20. Unsealed blocks 10, etc. may be used for lighting or other display purposes with access available through openings in the planar flange segments of the peripheral edge flanges 22 and 24. Noteworthy is the total accessibility achieved through complete removal of one half member 12 or 14 from the other, thus providing for open and clear access for inserting ornaments, lights, and/or figures other than lighting.

The blocks 10 are nearly unbreakable and this safety feature offers considerable savings on insurance premiums. This feature offers a major improvement for use of the blocks 10, 10A, 10B, 10C, etc. in basement windows, entry door sidelites, and other areas in commercial and residential buildings that cannot use glass blocks because of the breakage potential of glass. The blocks 10 can be used as an improvement or upgrade in those areas currently using glass blocks.

Tinting of the basic resins of the blocks 10 or tinting of the protective coating layer provides considerable security when the blocks are used in an outside wall installation. For example, during daylight hours, easy viewing to the outside is relatively constant, whereas, viewing from the outside inwardly may be reduced by 60%-80%.

Security against damage or breakage from small caliber firearms is exceptional as a thick section of polycarbonate on a side face 18 or 20 of a block 10 reduces bullet penetration significantly and/or may eliminate penetration altogether thereby significantly reducing the possibility of life loss.

The blocks 10 also have a high impact resistance against general vandal abuse resulting from thrown rocks, bottles, bats, etc. Significant damage because of cracking or shattering is almost eliminated, thus allowing blocks 10 to be installed in areas previously declared unsafe or hazardous. The blocks are especially useful in public housing or commercial buildings such as warehouses, parking garages, etc.

Coloring and tinting of the blocks 10 offers reduced light transmission from the harmful sunlight, infrared and ultraviolet light bands to the effect that heated air or cooled air can be better retained on the side of an installation where desired, along with a better quality rejection of heat or cold from an opposite side due to the reduced heat and light transmittance through the tinted walls of the blocks 10. This feature provides economy through heating and cooling cost reductions and protects against sun damage to interior furnishings and fixtures.

Many modifications and variations of the present invention are possible in light of the foregoing specification and thus, it is to be understood that within the scope of the appended claims, the invention may be practiced otherwise than as specifically described.

What is claimed and desired to be secured by Letters Patent of the United States is:

1. An architectural building block formed of light transmitting, molded plastic material to resemble a common glass block, comprising:

a plurality of hollow half members joined together along a seam to form a hollow block enclosure with said seam spaced intermediately between a pair of opposite outer side faces of said block, each half member having an inner surface and having an outer surface comprising one outer side face of said block integrally joined around its periphery to an inwardly directed peripheral edge flange having a free edge providing one joining edge of said seam; and at least one of said opposite outer side faces of said block having a thin, hard, transparent, abrasion, chemical and ultraviolet light resistant protective coating of plastic resin permanently bonded to said one opposite outer side face of said block.

2. The architectural building block of claim 1, including:

detachable connector means on said peripheral edge flange of at least one of said half members for securing said block to an adjacent block with adjacent facing surfaces of said blocks in spaced apart relation.

3. The architectural building block of claim 2, wherein:

said outer side face of each said half member has a periphery of polygonal shape and said peripheral edge flange thereof comprises a plurality of generally planar, angularly intersecting flange segments normal to said outer side face; and said connector means includes at least one connector on a planar flange segment spaced between said outer side face and said joining edge of said seam.

4. The architectural building block of claim 3, wherein:

said connector comprises a tongue and slot projecting outwardly of said planar flange segment for detachable interconnection with a slot and tongue of an adjacent block to maintain a space between said adjacent facing surfaces of said block and said adjacent block.

5. The architectural building block of claim 4, wherein:

said tongue of each connector is adapted to snap fit into a slot of a connector of an adjacent block.

6. The architectural building block of claim 5, wherein:

said tongues and slots slope angularly outwardly of said planar flange segment.

7. The architectural building block of claim 2, including:

an elongated continuous rib integrally formed on said peripheral edge flange of each half member spaced inwardly of said outer side face, and having an outwardly facing edge spaced inwardly of said outer side face extending around the periphery thereof.

8. The architectural building block of claim 7, wherein:

said rib is spaced outwardly of said connector means.

9. The architectural building block of claim 7, wherein:

the periphery of said outer side face of each half member is rounded and joins said outwardly facing edge of said rib.

10. The architectural building block of claim 9, wherein:

said joining edges of said seam comprise tongue and groove surfaces on said free edge of said peripheral edge flange.

11. An architectural building block formed of light transmitting, molded plastic material resembling a glass block, comprising:

a pair of halves adapted to be joined together along a peripheral seam to form a hollow building block with said seam spaced intermediately between parallel, opposite outside faces of generally rectangular shape, each of said halves including an inner surface and an outer surface comprising one of said opposite outside faces and a peripheral edge flange integrally joined to an outer peripheral edge of said outside face, said peripheral edge flange having an inner peripheral edge forming one joining edge of said seam; and a thin, hard, transparent, abrasion, chemical and ultraviolet light resistant protective coating of plastic resin permanently bonded to said outer surface of at least one of said halves.

12. The architectural building block of claim 11, including:

spacer means on said peripheral edge flanges of said block for maintaining a spaced apart relation between adjacent flanges of an adjacent block.

13. The architectural building block of claim 12, wherein:

said spacer means includes means for detachably interconnecting said block and said adjacent block.

14. The architectural building block of claim 11, including:

indicia means on said side face of at least one of said halves of said block.

15. The architectural building block of claim 14, wherein:

said indicia means is integrally molded on said side face.

16. The architectural building block of claim 11, including:

illumination means in said hollow building block for transmitting light outwardly through at least one of said side faces on said block.

17. The architectural building block of claim 16, wherein:

said illumination means comprises a plurality of elongated elements formed of light transmitting material and having inner ends for receiving light, and a common light source spaced adjacent said light receiving inner ends of said elongated elements.

18. The architectural building block of claim 11, wherein:

said spacer means comprises a plurality of elongated spacers having opposite end portions adapted to seat in recesses formed in said halves to provide a selected spacing interval between adjacent flanges of said block and an adjacent block.

19. The architectural building block of claim 11, including:

adhesive sealing means along said seam for securing said halves together to form said block.

20. The architectural building block of claim 11, wherein:

said joining edges of said halves of said block comprise a tongue and groove joint; and adhesive sealing means applied along said joint to secure said halves together and seal off the interior of said hollow block.

* * * * *